United States Patent [19]

Snyder

[11] Patent Number: 4,860,998

[45] Date of Patent: Aug. 29, 1989

[54] SLATTED CHAIN LINK FENCE CONSTRUCTION, SLATS THEREFOR, AND METHOD OF SLAT INSTALLATION

[76] Inventor: Daniel E. Snyder, 87 W. 750 North, Orem, Utah 84057

[21] Appl. No.: 113,061

[22] Filed: Oct. 26, 1987

[51] Int. Cl.[4] ..... B21F 27/00; E04H 17/02

[52] U.S. Cl. ..... 256/34; 256/35; 256/1; 245/11; 428/398; 29/464; 29/278

[58] Field of Search ..... 256/34, 32, 1, 45, 37, 256/46, 33, 35; 403/105; 245/11; 428/397, 398; 29/433, 464, 450, 235, 241, 278

[56] References Cited

U.S. PATENT DOCUMENTS

| | | | |
|---|---|---|---|
| 2,892,647 | 6/1959 | O'Neill | 403/105 |
| 2,954,964 | 10/1960 | O'Haffey | 256/34 |
| 3,227,423 | 1/1966 | DeMatteo | 256/34 X |
| 3,712,590 | 1/1973 | Tochner et al. | 256/34 |
| 3,958,794 | 5/1976 | Suprunuk et al. | 256/34 |
| 4,343,567 | 8/1982 | Sarver et al. | 256/1 |
| 4,570,906 | 2/1986 | Walden | 256/34 |
| 4,723,761 | 2/1988 | Cluff | 256/34 |

*Primary Examiner*—Peter M. Cuomo
*Attorney, Agent, or Firm*—Philip A. Mallinckrodt; Robert R. Mallinckrodt

[57] ABSTRACT

A slat for insertion in receiving channels of the wire mesh fencing fabric of a chain link fence has its longitudinal margins provided with respective fringes that are relatively thin and flexible for hugging the knuckles of the fencing fabric. The fringes are preferably a medium or low density polyethylene plastic or the like, and are preferably made up of transversely extending, flexible, but substantially position-maintaining strands, though they could be of transversely unbroken fin formation.

17 Claims, 1 Drawing Sheet

SLATTED CHAIN LINK FENCE CONSTRUCTION, SLATS THEREFOR, AND METHOD OF SLAT INSTALLATION

BACKGROUND OF THE INVENTION

1. Field

The invention is in the field of slatted chain link fence construction.

2. State of the Art

Chain link fneces are constructed of an open, wire mesh, fencing fabric woven diagonally so that alternate links zig-zag vertically and lie in different planes. The links form so-called "knuckles" where the wire forming them twists about the wire that forms laterally adjoining links. Thus, laterally adjoining channels are formed both vertically and diagonally along the height of fences constructed from such fencing mesh, which channels are open at their opposite ends. Since such fencing mesh is not closely woven, it does not conceal what is behind it on either side of a fence constructed therefrom, but merely protects against entry from one side or the other of the fence.

Because of this lack of concealment by the look-through nature of chain link fences, it has become customary to insert slats of wood, aluminum, or plastic in and along adjoining channels either vertically or diagonally. However, because of the knuckles, concealment is not complete by such insertion of slats.

Efforts have been made to provide slats that would give a greater degree of concealment than do slats with ordinary rectilinear margins. Thus, an aluminum slat is obtainable commercially that is notched along one of its longitudinal margins at intervals corresponding to knuckle intervals in the particular mesh size of the fencing mesh concerned. Slats of this type are inserted in the diagonal channels, with the notched edges facing downwardly so the marginal tabs between notches can be slid between the knuckles and will remain there by reason of gravity acting on the slats. The unnotched, opposite, longitudinal margins of the so-inserted slats cover the notches of the upwardly adjoining slats and provide a diagonally slatted, closed mesh that largely prevents look-through, although series of openings corresponding to the notches remain. Because of the reliance on gravity to maintain the slats in the proper position, this system can only be used with slats positioned diagonally.

3. Objectives

In the making of the present invention it was a primary objective to provide more effective concealment by fencing slats, whether inserted in vertical or diagonal channels in the wire mesh fencing fabric. It was also an object to make slat removal difficult so as to lessen the likelihood of slat theft from inserted positions in the fencing fabric.

BRIEF SUMMARY OF THE INVENTION

In achieving the foregoing objectives, a slat is provided with longitudinal fringes that are relatively thin and flexible, preferably stiffly so with some elasticity. It is preferred that the slat be of an extruded plastic, such as a medium or low density polyethylene, and that the respective longitudinal margins of such slat be cut transversely into multiple strand fringes that extend transversely in a continuous series from end-to-end of the slat and hug the knuckles of the wire fabric of the fence. However, they could be of transversely unbroken fin formation for somewhat similarly hugging the knuckles. Such a fringed, plastic slat is easily inserted in a receiving channel of the wire mesh fencing, whether a vertical or diagonal channel, either on its own or with the aid of a rigid insertion tool, depending upon the density of the plastic forming the body member of the slat. Withdrawal is hindered by the fringed nature of the slat.

Reference is made to Disclosure Document No. 172876 filed June 17, 1987.

THE DRAWING

The best mode presently contemplated for carrying out the invention in practice is illustrated in the accompanying drawing, in which:

FIG. 1 is an elevational view of a chain link fence slatted with multiple strand fringed slats in accordance with the invention, an intermediate portion being broken out for convenience of illustration;

FIG. 2, a horizontal section taken on the line 2—2 of FIG. 1;

FIG. 3, a view similar to that of FIG. 1 but showing a single slat, the view being drawn to scale;

FIG. 4, a transverse section taken on the line 3—3 of FIG. 2 and drawn to a larger scale;

FIG. 5, a view similar to that of FIG. 3 but showing, in front elevation, one embodiment of slat insertion tool;

FIG. 6, a side elevational view looking from the right in FIG. 5;

FIG. 7, a fragmentary vertical section taken along the length of FIG. 4 immediately in front of the insertion tool of FIGS. 4 and 5 as anchored to the lower end of the slat; and FIG. 8, a corresponding view taken as the insertion tool is being withdrawn following installation of the slat.

DETAILED DESCRIPTION OF THE ILLUSTRATED EMBODIMENT

Figure 1:
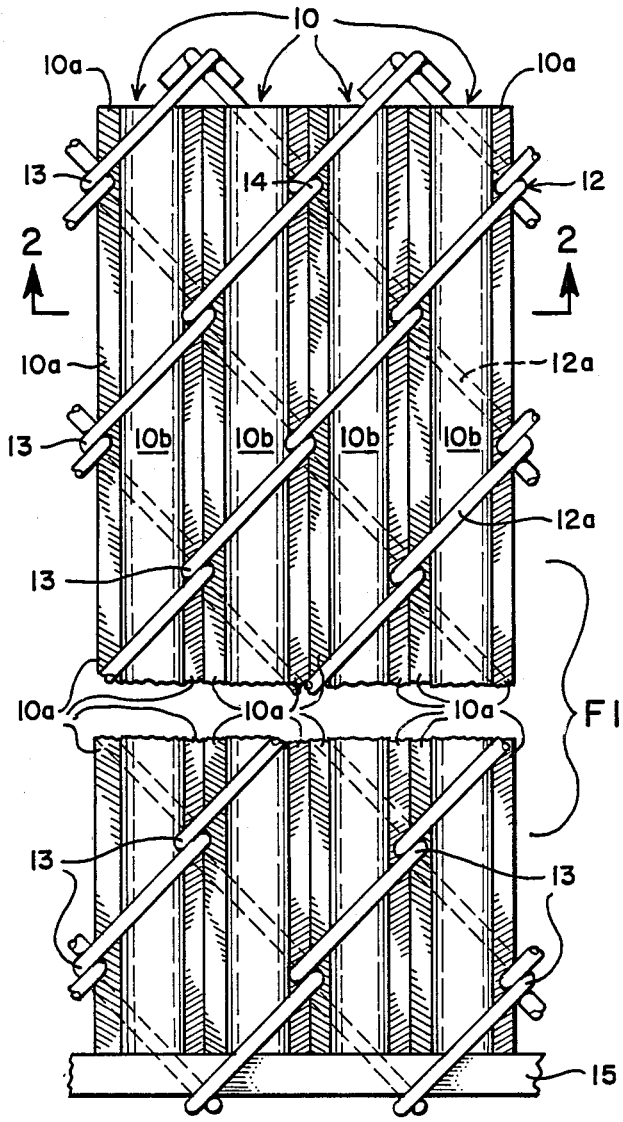

As illustrated in FIG. 1, fringed slats 10 of the invention have multiple strand fringes **10*a* that are thin and flexible relative to the intermediate bodymember 10*b* of the slat. They are preferably positioned in vertical channels 11 of the wire mesh fencing fabric 12*a* of a chain link fence 12, with their fringes 10*a* closely hugging the knuckles 13** of such wire mesh along opposite longitudinal margins of such slats. No openings similar to those left by the aforedescribed prior notched slats are left. The fence is effectively closed against look-through. Although multiple strand fringes such as those illustrated are preferred, the fringes could be uncut flanges fringing the body member.

The slats are preferably extruded to the shape illustrated from a suitable plastic material, such as a medium density polyethylene, which will withstand a wide range of atmospheric temperatures from very hot to very cold. As extruded to the shape shown in the illustrated form of the invention, the slat has a hollow body member **10*b* and relatively thin but preferably stiffly flexible flanges fringing opposite longitudinal sides of the body member. The flanges are preferably then cut transversely to provide the multiple strand fringes 10*a***.

Figure 2:
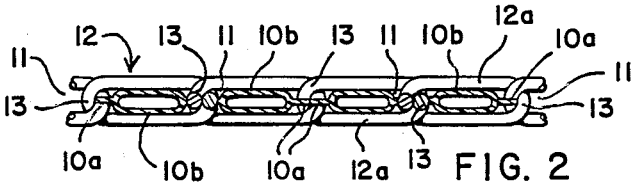
Figure 7:
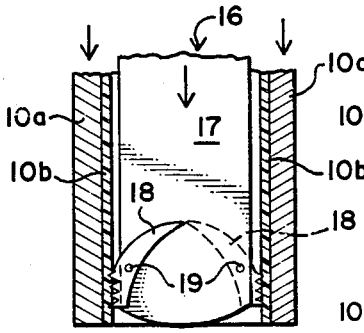
Figure 8:
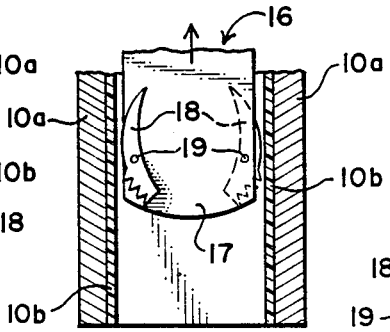

The width of body member **10*b* of the slat will depend upon the width of the receiving channels in the chain link fence into which the slats are to be installed. For the most usual channel width, the width of body member 10*b* of the slat will be one and one-eighth inches, with a fringe on each side three-sixteenths of an inch in width. The thickness of the slat will be one-quarter of an inch, and each strand 14 of the fringes will be about one-sixteenth of an inch in width. As installed, the fringe will surround and hug the knuckles 13 of the wire fencing mesh. For this purpose and as shown in FIGS. 1 and 2** of the drawing, the body member has width approximately the width of the channel into which the slat is inserted, with fringes whose widths extend beyond the width of the channel at respective opposite sides thereof so as, together with the fringes of adjoining slats, surround and hug the adjoining knuckles.

Slat length will normally correspond with fencing channel length. A horizontal ordinary slat or board 15 may be placed along the bottom margin of the fence at each side thereof as is now customary for most slatted chain link fences, but this is merely for appearance since it is not necessary for the purpose of holding the slats in place.

Figure 4:
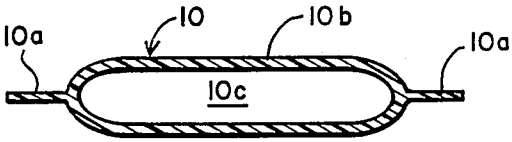
Figure 3:
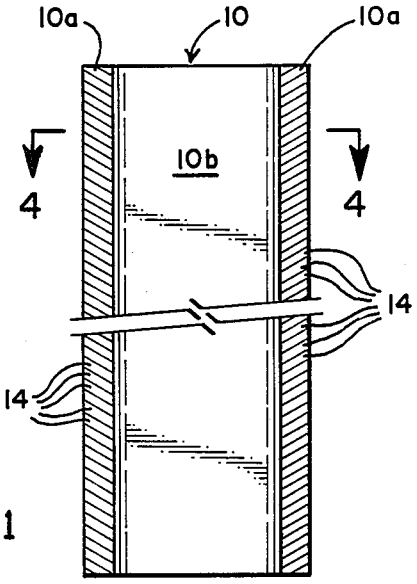
Figure 5:
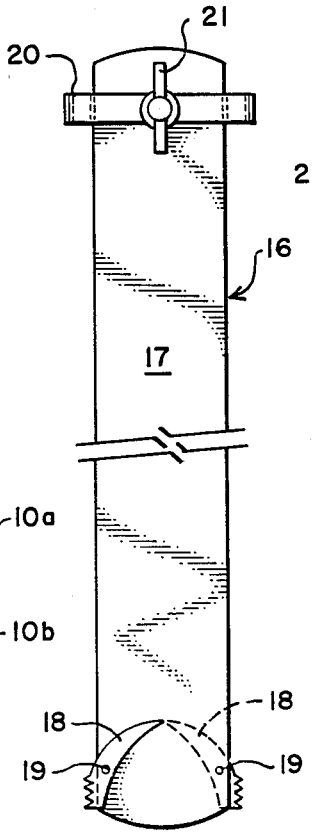
Figure 6:
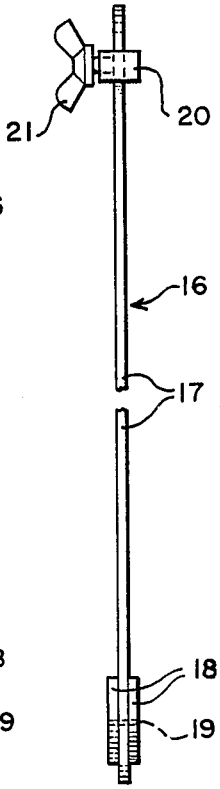

For aiding insertion of slats 10 in the vertical receiving channels 11 of the wire fencing mesh 12*a*, or in diagonal channels of such mesh when desired, a rigid insertion tool may be employed, such as shown at 16 in FIGS. 4 and 5. In the form illustrated, tool 16 comprises a relatively rigid shank member 17 of length somewhat greater than the length of the slat to be inserted, of thickness capable of being slid into the hollow interior 10*c* of a slat 10, and of width sufficient to provide desired stiffening but in any case somewhat less than the width of the hollow interior 10*c* of a slat 10. A pair of elongate, serrated blade members 18, respectively, are pivoted intermediate their lengths to opposite sides, respectively, of shank member 17 at its lower end as levers counterbalanced by the positions of their pivots 19 to normally keep them protruding outwardly except during withdrawal of the tool. The tool is inserted from the bottom end of the slat, handle end first, so that the blade members 18 will engage opposite sides of the lower end of the slat, interiorly thereof. The slat with tool inside can then be inserted into the upper end of a receiving channel 11 of the fencing fabric. A gentle tub on the tool will release the blade members, thereby enabling the tool to be withdrawn from the slat.

A bar 20 provided with a slot for receiving the upper end of shank member 17 may be inserted over the upper end of such shank member and clamped into position on the shank member by means of a thumb screw 21 to exert force on the upper end of the slat as tool 16 is pushed during its slat-insertion stroke, such bar being longer than the width of the body member of the slat and slidable along the length of the salt so its position may be adjusted as the slat is inserted in its receiving channel of the fencing mesh.

For slats that are not hollow, a transverse slit may be provided across and short of the width of the slat for receiving the lower end of an insertion tool provided only with an elongate shank of width less than the width of the body of the slat and with laterally extending members spaced upwardly from the lower end of the shank and protruding beyond the slit for bearing against the margins of the shank at the slit during the insertion stroke of the tool.

Although it is presently preferred to provide the fringes integrally with the body member, as illustrated, it should be realized that the fringes may be separately formed and secured in some suitable manner, as by an adhesive, to the longitudinal margins of a separately formed body member. Moreover, as previously indicated, the fringes may be provided by respective lengths of relatively thin and flexible plastic material as fins that tend to surround and hug the knuckles of the fencing fabric without being cut transversely into individual strands. In this case, a low density polyethylene plastic can be used for such flange fringes and also for the body member of the slat if provision is made for use of a rigid insert tool as described above.

The use of a medium or low density polyethylene or similar plastic material is preferred, at least for the fringe portions of the slats, but a high density plastic may sometimes be used effectively, especially for low fences where slat lengths are relatively short.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A slatted chain link fence, comprising chain link fence structure having wire mesh fencing fabric with knuckles at wire intersections and providing slat-receiving channels extending from top to bottom of such fencing fabric a plurality of slats in the respective channels, each slat having an elongate, imperforate body member of slat formation with a width approximating the width of its associated receiving channel; fringes that are thin and flexible relative to said body member, said fringes extending along and outwardly from respective opposite longitudinal sides of said body member beyond said width of the receiving channel so as to surround and hug said knuckles, and each of said fringes being made up of a plurality of closely adjoining, substantially position-maintaining strands extending transversely from the body member.

2. A slatted chain link fence according to claim 1, wherein each strand of the fringes is approximately one-sixteenth of an inch in width.

3. A slatted chain link fence according to claim 1, wherein the fringes are made of a plastic material having the characteristics of no greater than a medium density polyethylene.

4. A slatted chain link fence according to claim 3, wherein the body member of the slat and the fringes are made integrally of the same plastic material.

5. A slatted chain link fence according to claim 1, wherein the slat is hollow.

6. A slatted chain link fence according to claim 1, wherein the fringes are made of a plastic material having the characteristics of greater than a medium density polyethylene.

7. A slatted chain link fence according to claim 6, wherein the body member of the slat and the fringes are made integrally of the plastic material.

8. A slatted chain link fence according to claim 7, wherein the slat is hollow.

9. A slat for insertion in an upwardly and downwardly extending receiving channel of the wire mesh fencing fabric of a chain link fence, said channel being bordered along its opposite sides by respective series of intermittently spaced, wire intersection knuckles, said-slat comprising an elongate, imperforate body member of slat formation with a width approximating the width of its associated receiving channels fringes that are thin and flexible relative to said body member, said fringes extending along and outwardly from respective opposite longitudinal sides of said body member beyond said width of the receiving channel so as to surround and hug said kunckles when the slat is installed in said receiving channel of wire mesh fencing fabric of a chain link fence and each of said fringes being made up of a plurality of closely adjoining, substantially position-maintaining strands extending transversely from the body member.

10. A slat according to claim 9, wherein each strand of the fringes is approximately one-sixteenth of an inch in width.

11. A slat according to claim 9, wherein the fringes are made of a plastic material having the characteristics of no greater than a medium density polyethylene.

12. A slat according to claim 11, wherein the body member of the slat and the fringes are made integrally of the same plastic material.

13. A slat according to claim 9, wherein the slat is hollow.

14. A slat according to claim 9, wherein the fringes are made of a plastic material having the characteristics of no greater than a medium density polyethylene.

15. A slat according to claim 14, wherein the body member of the slat and the fringes are made integrally of the plastic material.

16. A slat according to claim 15, wherein the slat is hollow.

17. A method of inserting a slat in a downwardly, extending receiving channel of the wire mesh fencing fabric of a chain link fence, said channel being bordered along its opposite sides by respective series of intermittently spaced, wire intersection knuckles, said slat having an elongate imperforate body member of slat formation with a width approximating the width of its receiving channel; fringes that are thin and flexible relative to said body member, said fringes being made up of a plurality of closely adjoining, substantially position - maintaining strands and extending along and outwardly from respective opposite sides of said body member beyond said width of the receiving channel so as to surround and hug said knuckles when the slat is installed in said receiving channel of wire mesh fencing fabric of a chain link fence, comprising the steps of applying to the slat an insertion tool having a rigid shank and upper and lower ends, with the lower ends of the shank withdrawably anchored to the portions of the side walls of the slat during the insertion of the slat; and withdrawing said tool at the termination of said insertion, the slat being hollow, and the insertion tool being provided with counterbalanced blades at opposite longitudinal sides of the lower end of the shank, counterbalanced to normally protrude slightly from said longitudinal sides, said tool being inserted within the hollow of the slat from the lower end thereof, handle end first, so that said blades protrude against and dig into opposite longitudinal sides of the hollow of the slat, and said tool being manipulated as the insertion stroke terminates to retract and release said blades for withdrawal of the tool by way of the upper end of the slat.

* * * * *

UNITED STATES PATENT AND TRADEMARK OFFICE

CERTIFICATE OF CORRECTION

PATENT NO. : 4,860,998

DATED : August 29, 1989

INVENTOR(S) : Daniel E. Snyder

It is certified that error appears in the above-identified patent and that said Letters Patent is hereby corrected as shown below:

Column 3, line 7, "approximately" should be "approximating"

In the Claims:

Column 4, line 27, there should be a semicolon after the word "fabric".

line 48, the word "same" should be deleted.

line 53, the word "no" should be inserted before the word "greater".

UNITED STATES PATENT AND TRADEMARK OFFICE

CERTIFICATE OF CORRECTION

PATENT NO. : 4,860,998

DATED : August 29, 1990

INVENTOR(S) : Daniel E. Snyder

It is certified that error appears in the above-identified patent and that said Letters Patent is hereby corrected as shown below:

line 67, "channels" should be "channel" and a semicolon should be inserted thereafter.

Column 5, line 6, a comma should be inserted after the word "fence".

line 18, the word "same" should be deleted.

Signed and Sealed this

Twenty-second Day of June, 1993

*Attest:*

Michael K. Kirk

MICHAEL K. KIRK

*Attesting Officer*

*Acting Commissioner of Patents and Trademarks*